United States Patent [19]

Rivman et al.

[11] 3,965,952

[45] June 29, 1976

[54] PLASTIC SNAP FASTENER

[75] Inventors: Samuel J. Rivman, White Plains; Bernard Cohen, Spring Valley; Alvaro Da Costa, Garnerville, all of N.Y.

[73] Assignee: Eastern Poly Packaging Company, Brooklyn, N.Y.

[22] Filed: Nov. 13, 1972

[21] Appl. No.: 306,273

[52] U.S. Cl. ..... 150/3; 24/208 A; 2/265

[51] Int. Cl.[2] ..... B65D 33/16; A44B 7/00

[58] Field of Search ..... 150/3, 7; 24/208 A, 24/216, 217; 2/265, 337

[56] References Cited

UNITED STATES PATENTS

| | | | |
|---|---|---|---|
| 2,724,884 | 11/1955 | Jones | 24/208 A |
| 2,895,199 | 7/1959 | Jones | 24/218 X |
| 3,130,464 | 4/1964 | Barlow | 24/208 A |
| 3,152,376 | 10/1964 | Boser | 24/216 |
| 3,213,507 | 10/1965 | Christian | 24/208 A |
| 3,243,858 | 4/1966 | Melanson | 24/208 A |
| 3,466,714 | 9/1969 | Nysten | 24/208 A |

*Primary Examiner*—Herbert F. Ross
*Attorney, Agent, or Firm*—Hubbell, Cohen, Stiefel & Gross

[57] ABSTRACT

This invention is a dual element, plastic snap fastener assembly for bags, raincoats, cartons, portfolios and the like. Each fastener element in the assembly is sealed to one side of its supporting material with its coupling member, i.e. a stud or socket, projecting through an aperture in the material to the other side of the material where the coupling member is interengaged by the cooperating member of the other element in the assembly.

4 Claims, 8 Drawing Figures

PLASTIC SNAP FASTENER

FIELD OF INVENTION

The present invention relates to snap fasteners and more particularly the invention is directed to snap fastener elements molded from plastic material. The invention also relates to fasteners attached to a supporting member to form a complete assembly of two joined members.

BACKGROUND OF INVENTION

Heretofore, snap fasteners were usually made of metal but it has now been recognized that when such fasteners are made of a plastic they have certain advantages as compared to metal snap fasteners in respect to economy and ease of manufacture, enhanced appearance, adaptability to be colored as desired for any application, and ease of securing to a supporting member.

It is the general object of the invention to provide such a plastic snap fastener possessing the aforesaid advantages while at the same time to provide an improvement over the snap fastener of the type as shown in U.S. Pat. Nos. 3,083,429, 3,243,858 and 3,270,385. Each of these patents shows a strip of snap fastener components of the stud and socket type; and, in the latter two patents, the components are dielectrically heat sealed to a supporting member whereas the components in the former patent are secured to supporting member by a high frequency heat sealing method.

Another object of the invention is to provide a plastic snap fastener in which the separable elements are effectively aligned and securely heat sealed to supporting members for repeatedly joining and disjoining the members with ease thus providing, for example, an improvement over the fastener disclosed in U.S. Pat. No. 3,152,376.

The foregoing and other objects will become evident from the following summary of the invention, the description of the preferred embodiment, and the attached drawings.

SUMMARY OF THE INVENTION

In its broadest aspect, the present invention relates to a snap fastener unit of two separable elements having cooperating coupling members wherein the elements are so formed that they can be readily connected and disconnected.

In a narrower aspect, the invention relates to a snap fastener unit of two separable elements of relatively resilient material, each of the elements comprising a base with a coupling member projecting upwardly therefrom. In a more limited aspect, each coupling element is a cylinder wherein the first of said cylinders has a peripheral ridge on its inside surface, and the second has a peripheral ridge on its outside surface, the second cylinder having a diameter smaller than the first so that the second can snap fasten into the first.

In another aspect, the present invention relates to the aforedescribed snap fastener assembly being secured to an article or to supporting materials such as substrates wherein the elements are heat sealed to superimposed substrates in a manner to permit joining and disjoining the substrates without placing excessive force directly on the seal securing the elements to their respective substrates.

BRIEF DESCRIPTION OF THE DRAWINGS

In the drawings which are attached hereto and made a part of this specification.

DESCRIPTION OF THE PREFERRED EMBODIMENT

Figure 1:
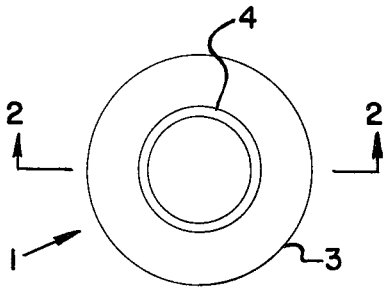
FIG. 1 is a top plan view of an element made in accordance with the first embodiment of the present invention.
Figure 2:
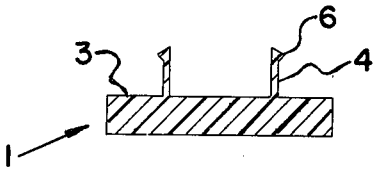
FIG. 2 is a section view along lines 2—2 of FIG. 1.

In FIGS. 1 and 2, element 1 of the fastener assembly or unit of the first embodiment is shown which includes a single piece of plastic having a relatively wide and preferably circular base 3 with a stud which can be a tube or hollow cylinder 4 located centrally thereof. As shown in FIG. 2 there is a ridge or rib 6 at least partially around the outer periphery of the open end of the cylinder.

Figure 3:
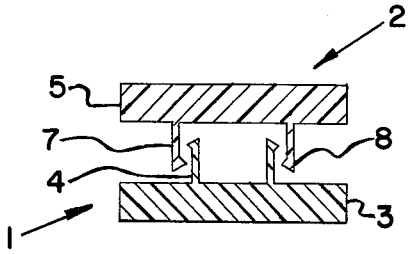
FIG. 3 is a cross-section view through the elements of the first embodiment of the invention showing the elements interengaged.

As can be seen in FIG. 3, a complementary element 2 of the snap fastener assembly is of a similar configuration; i.e., a base 5 having a cylinder 7 projecting from the center thereof with a rib 8 on the inner periphery of the open end of the cylinder. The inner diameter of element 2 is greater than the outer diameter of element 1 to the extent to permit the rib of element 1 to enter past the inner rib of element 2 in snap engagement as shown in FIG. 3. The cylinders may be any shape, preferably circular, as long as the cylinders of cooperative elements of a fastener assembly are the same shape or are geometrically compatible to permit the joining and disjoining thereof. The natural resiliency of thermoplastic materials makes such materials preferred for the snap fasteners of this invention as such resiliency permits easy joining and disjoining of the snap fastener elements.

Figure 4:
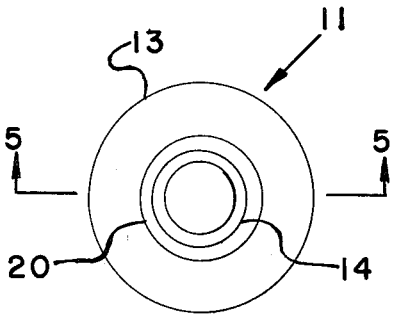
FIG. 4 is a top plan view of an element made in accordance with the second embodiment of the present invention.
Figure 5:
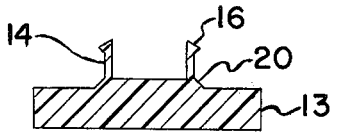
FIG. 5 is a sectional view along lines 5—5 of FIG. 4.
Figure 6:
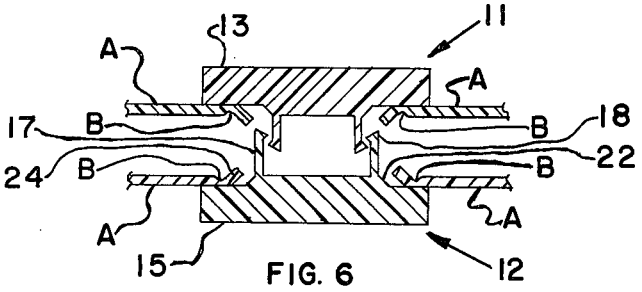
FIG. 6 is a cross section view through the elements of the second embodiment of the invention secured to a substrate showing the elements interengaged.

Referring now to FIGS. 4–6, there is seen the similarity of the elements or parts and the operation of same of the first and second embodiments of this invention. Elements 11 and 12 of the snap fastener unit or assembly of the second embodiment include bases 13 and 15 with tubes or hollow cylinders 14 and 17 respectively projecting upwardly therefrom, each having a rib 16 and 18, respectively. As shown, rib 16 is around the uppermost part of the outside wall of cylinder 14 of element 11, and rib 18 is around the uppermost part of the inner wall of the cylinder. Bases 13 and 15 have a raised portion or collar 20 and 22 immediately adjacent and surrounding cylinders 14 and 17, respectively.

The snap fastener elements are each formed of heat sealable type plastic which is suitable for molding and has the required rigidity after molding. Such plastics are well known in the art and include such materials as may be derived from polyethylene, polypropylene, polyvinyl chloride, or blends or combinations of any of these or other known thermoplastic resins.

Referring to FIG. 6, there is illustrated an assembly or unit embodying the invention wherein the elements of the second embodiment are shown interengaged and attached to superimposed layers of a substrate or supporting member A. It is to be understood that the elements of both embodiments may be attached in the same manner, but for the sake of brevity only the elements of the second embodiment will be described.

The superimposed layers of substrate or article A have coincident apertures through which the cylinder and collar of the respective elements project. The base of the element may be secured to the supporting member in any suitable manner, preferably heat sealed. As shown in FIG. 6 heat seal B may be completely or partially around the collar; i.e., it may be a horse shoe-shaped seal or part of a circle. (See, e.g. seal B in FIG. 8.)

From FIG. 6 several particular advantages of the present invention may be appreciated. First, each fastener element is adhered only to one side of the film with its coupling or fastening member, i.e. stud or socket, projecting through an aperture so that the force of unsnapping the element is carried by the whole upper surface of the base of the element bearing against the film so that the seal itself does not have to be subjected to such force. In some prior art snap fasteners in which the base and the coupling member are on the same side of the film, the seal itself carries all of the force of the unsnapping operation. In such fasteners, the seal can easily be broken and the fastener pulled from the film. The film may even tear as heat sealing operations will often weaken the seal around the fastener.

In other prior art snap fasteners in which the base has two sections, each of the two base sections being on opposite sides of the film and the two sections being joined by multiple penetrations of the film, the force of disengaging or unsnapping the elements is carried through the penetrations. Each penetration weakens the film and often the penetrations serve as initiating points from which a tear will propagate. Also the increasing number of components for each snap fastener makes the process of securing the fasteners to the bag slower and more cumbersome. The snap fastener assembly of the present invention overcomes the above mentioned disadvantages in the prior art; and, as can be seen in FIG. 6, a minimum number of film penetrations are required and the uncoupling force is distributed over a relatively wide area.

Figure 7:
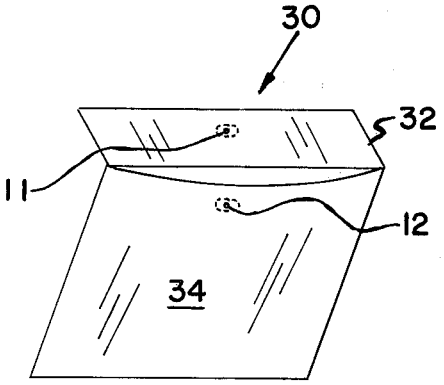
FIG. 7 is a perspective view of a bag embodying the invention.

FIG. 7 shows a reclosable thermoplastic bag 30 having a flap 32 and a body 34 with the elements of the fastener assembly attached thereto. Either one of the cooperative elements may be attached to the flap and the other cooperating element attached to the body of the bag to permit the closing and opening of the bag.

The article or bag 30 may be made of any suitable heat sealable material as listed heretofore; preferably, the bag and elements are made of the same type thermoplastic material.

Figure 8:
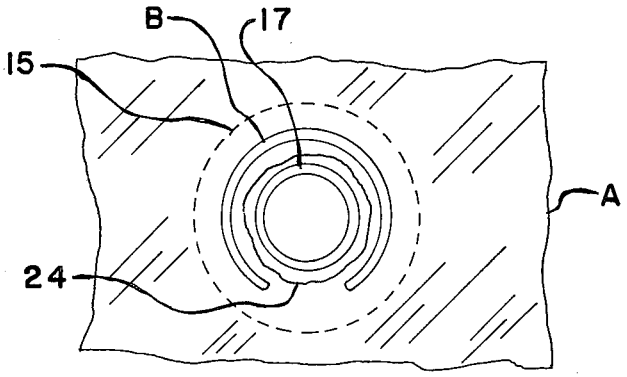
FIG. 8 is a top plan view of a fastener according to the present invention attached to film and showing the seal securing the fastener to the film.

FIG. 8 is a view looking down on a fragment of film A which can be a bag wall to which the base 15 of a snap fastener projecting through aperture 24 is sealed by seal B at least partially around the aperture 24. The portion of the snap fastener which projects through the aperture is one of the coupling members, i.e. either a stud or a socket, which, as illustrated, is a socket 17. When thermoplastic bag material is employed with a thermoplastic fastener, it is often desirable that the upper surface of the base 15 in the area to which the seal B is to be made be roughened. This roughening may be a regular grid-like pattern or it may be a randomly roughened surface. The purpose of the roughened surface is to provide more sealing surface area and to allow the projections caused by roughening to penetrate somewhat the film surface thus promoting better adhesion.

The present invention can be used wherever it is desired to temporarily join two supporting materials, particularly supporting materials which are sheet-like in nature whether they be flexible or substantially rigid. Besides bags, the invention can be used for raincoats, shower curtains, cartons, portfolios, and the like.

We claim:

1. A reclosable bag of a heat sealable material having a snap fastener unit comprising:

a. a bag with a flap having complementary apertures in the flap and in the bag body;

b. said unit having two separable fastener elements;

c. each of said elements having a base with a cylinder projecting upwardly therefrom;

d. each of the bases of said elements comprising:

1. a raised collar portion immediately adjacent the cylinder; and, 2. a peripheral flange portion;

e. the cylinder of the first element having a horizontal rib on the upper portion of the inner surface thereof;

f. the cylinder of the second element having a horizontal rib on the upper portion of the outer surface thereof to cooperate with the rib of the first element to snap said elements together;

g. the element bases having a roughened upper surface;

h. the cylinder and collar of one of said elements projecting through an aperture in the flap of said bag to permit the upper surface of the flange portion of said base to be heat sealed to said flap;

i. the cylinder and collar of the other of said elements projecting through an aperture in the body of said bag to permit the upper surface of the flange portion of said base to be heat sealed to the body of said bag;

j. the flap element and the body element being positioned to permit closing and opening of said bag upon fastening and separating said elements thereby providing a reclosable bag.

2. A reclosable bag of claim 1, wherein the heat seal encircles the collar.

3. A reclosable bag of claim 1, wherein the elements and the bag are of the same type material.

4. A reclosable bag of claim 3, wherein said material is a polyolefin.

* * * * *